US009279427B2

(12) United States Patent
Tseng et al.

(10) Patent No.: US 9,279,427 B2
(45) Date of Patent: Mar. 8, 2016

(54) COOLING SYSTEM FOR A GENERATOR OF A VEHICLE

(71) Applicant: Kwang Yang Motor Co., Ltd., Kaohsiung (TW)

(72) Inventors: Chien-Ping Tseng, Kaohsiung (TW); Wen-Ming Su, Kaohsiung (TW)

(73) Assignee: KWANG YANG MOTOR CO., LTD., Kaohsiung (TW)

( * ) Notice: Subject to any disclaimer, the term of this patent is extended or adjusted under 35 U.S.C. 154(b) by 694 days.

(21) Appl. No.: 13/684,834

(22) Filed: Nov. 26, 2012

(65) Prior Publication Data

US 2013/0136580 A1 May 30, 2013

(30) Foreign Application Priority Data

Nov. 29, 2011 (TW) ..... 100143694 A

(51) Int. Cl.
*F04D 25/00* (2006.01)
*F04D 29/58* (2006.01)

(52) U.S. Cl.
CPC ..... *F04D 25/00* (2013.01); *F04D 29/582* (2013.01)

(58) Field of Classification Search
CPC ..... F04D 29/582; F04D 25/00; H02K 9/00; H02K 9/10
USPC ..... 180/65.51; 415/121.3; 290/1 B
See application file for complete search history.

(56) References Cited

U.S. PATENT DOCUMENTS

| | | | | |
|---|---|---|---|---|
| 4,647,835 | A * | 3/1987 | Fujikawa et al. | 322/1 |
| 5,233,255 | A * | 8/1993 | Kusumoto et al. | 310/263 |
| 5,751,079 | A * | 5/1998 | Bagherpour et al. | 310/59 |
| 6,622,806 | B1 * | 9/2003 | Matsuura | 180/68.1 |
| 7,255,188 | B2 * | 8/2007 | Tsukada et al. | 180/65.51 |
| 7,546,818 | B2 * | 6/2009 | Hirayama et al. | 123/41.01 |

* cited by examiner

*Primary Examiner* — Brodie Follman
*Assistant Examiner* — Brian Cassidy
(74) *Attorney, Agent, or Firm* — Rabin & Berdo, P.C.

(57) ABSTRACT

A cooling system for a generator of a vehicle has an engine, a generator and a wind collection box. The generator has a rotor driven by the engine and a fan synchronously rotating with the rotor. The wind collection box is connected to the generator via a first guiding tube. The fan draws exterior air from the wind collection box and the first guiding tube to allow the exterior air to flow through the generator. Thus, heat in the generator that is mounted in an airtight engine compartment is dissipated.

15 Claims, 5 Drawing Sheets

COOLING SYSTEM FOR A GENERATOR OF A VEHICLE

BACKGROUND OF THE INVENTION

1. Field of the Invention

The present invention relates to a cooling system of a vehicle, especially to a cooling system that dissipates heat of a generator mounted in an airtight engine compartment of a vehicle.

2. Description of the Prior Art(s)

To provide electricity to electric equipments, such as a lamp, an air conditioner, and a battery, of a vehicle, a generator is prepared in the vehicle. The generator is driven by an engine to generate the electricity. However, when the generator rotates at high speed under heavy load, temperature of the generator rises. If heat of the generator is not dissipated timely to lower the temperature of the generator, the generator will not operate well.

A conventional generator has a housing with multiple heat dissipating holes. Heat in the housing can be dissipated via the heat dissipating holes to lower temperature of the conventional generator. However, generally, the conventional generator is mounted in an airtight engine compartment together with an engine. Therefore, the heat that is dissipated via the heat dissipating holes of the housing of the generator is unable to be further dissipated to an exterior of the engine compartment such that air in the engine compartment and air outside the engine compartment are unable to circulate. Consequently, the temperature of the generator still rises constantly and a lifetime of the generator is shortened.

To overcome the shortcomings, the present invention provides a cooling system for a generator of a vehicle to mitigate or obviate the aforementioned problems.

SUMMARY OF THE INVENTION

The main objective of the present invention is to provide a cooling system for a generator of a vehicle. The cooling system has an engine, a generator and a wind collection box. The generator has a rotor driven by the engine and a fan synchronously rotating with the rotor. The wind collection box is connected to the generator via a first guiding tube. The fan draws exterior air from the wind collection box and the first guiding tube to allow the exterior air to flow through the generator. Thus, heat in the generator that is mounted in an airtight engine compartment is dissipated.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
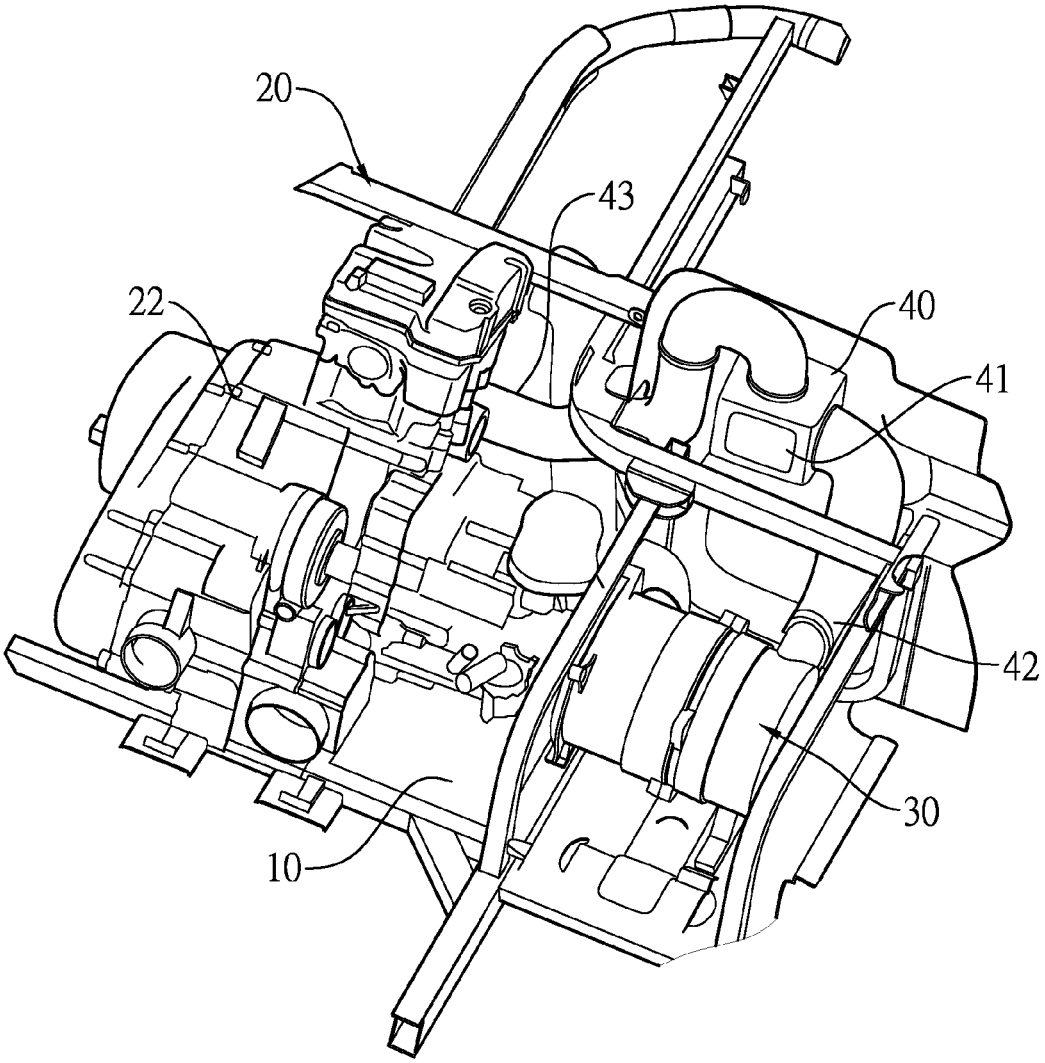
FIG. 1 is a front perspective view of a cooling system for a generator of a vehicle in accordance with the present invention.
Figure 2:
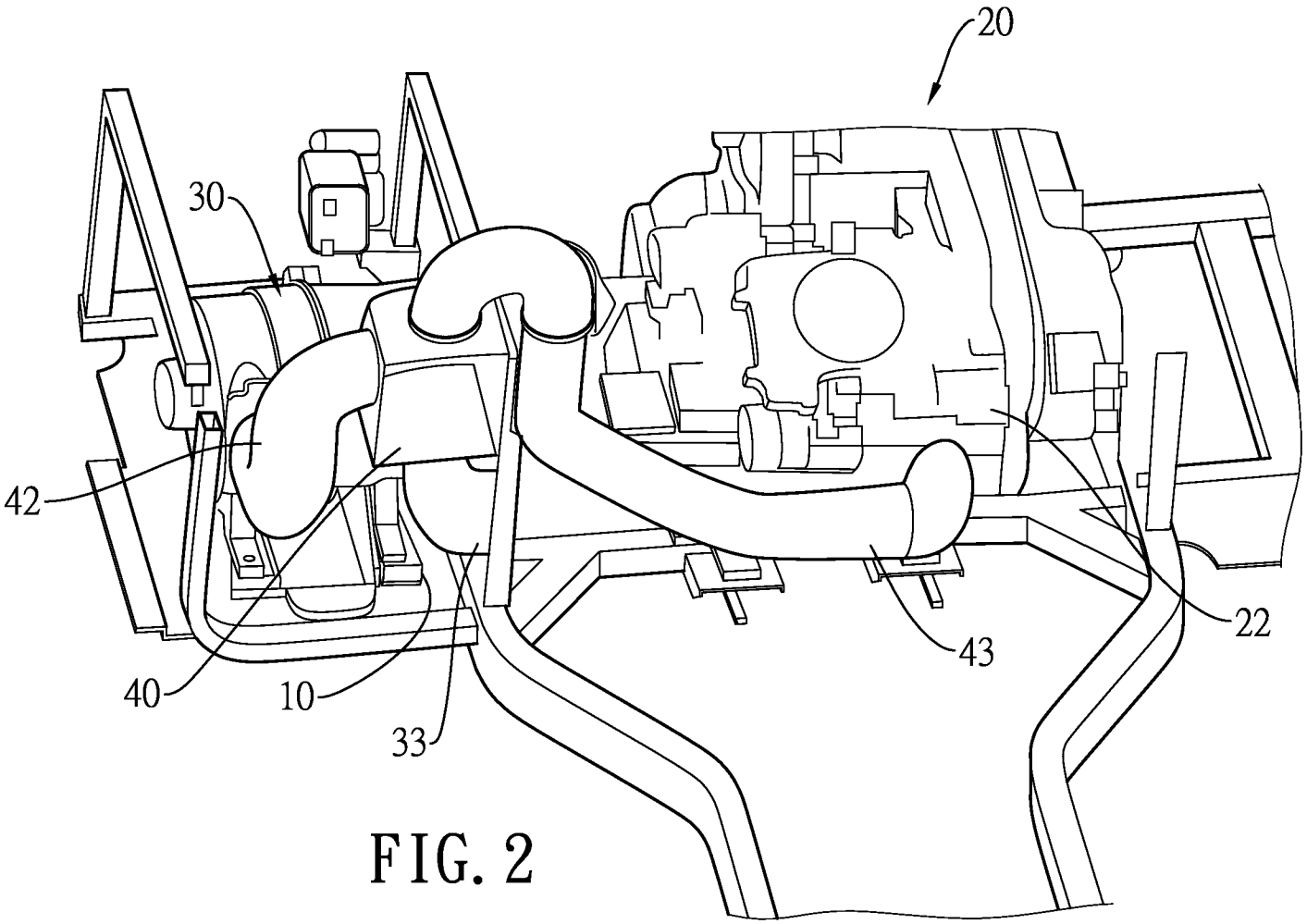
FIG. 2 is a rear perspective view of the cooling system in FIG. 1.
Figure 3:
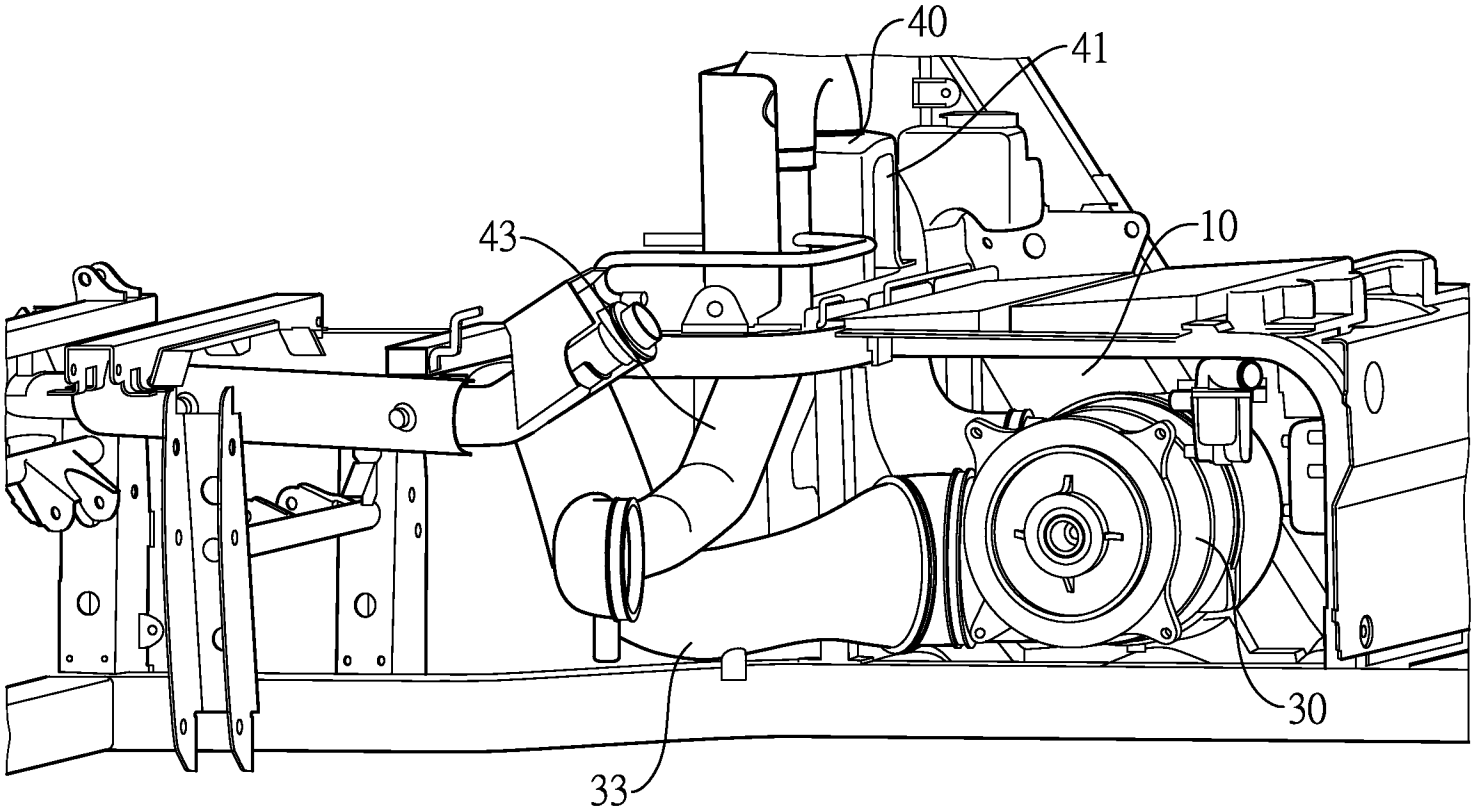
FIG. 3 is a left perspective view of the cooling system in FIG. 1.

With reference to FIGS. 1 to 3, a cooling system for a generator of a vehicle in accordance with the present invention is mounted in an airtight engine compartment 10 of the vehicle and comprises an engine 20, a transmission box 22, a generator 30 and a wind collection box 40.

Figure 5:
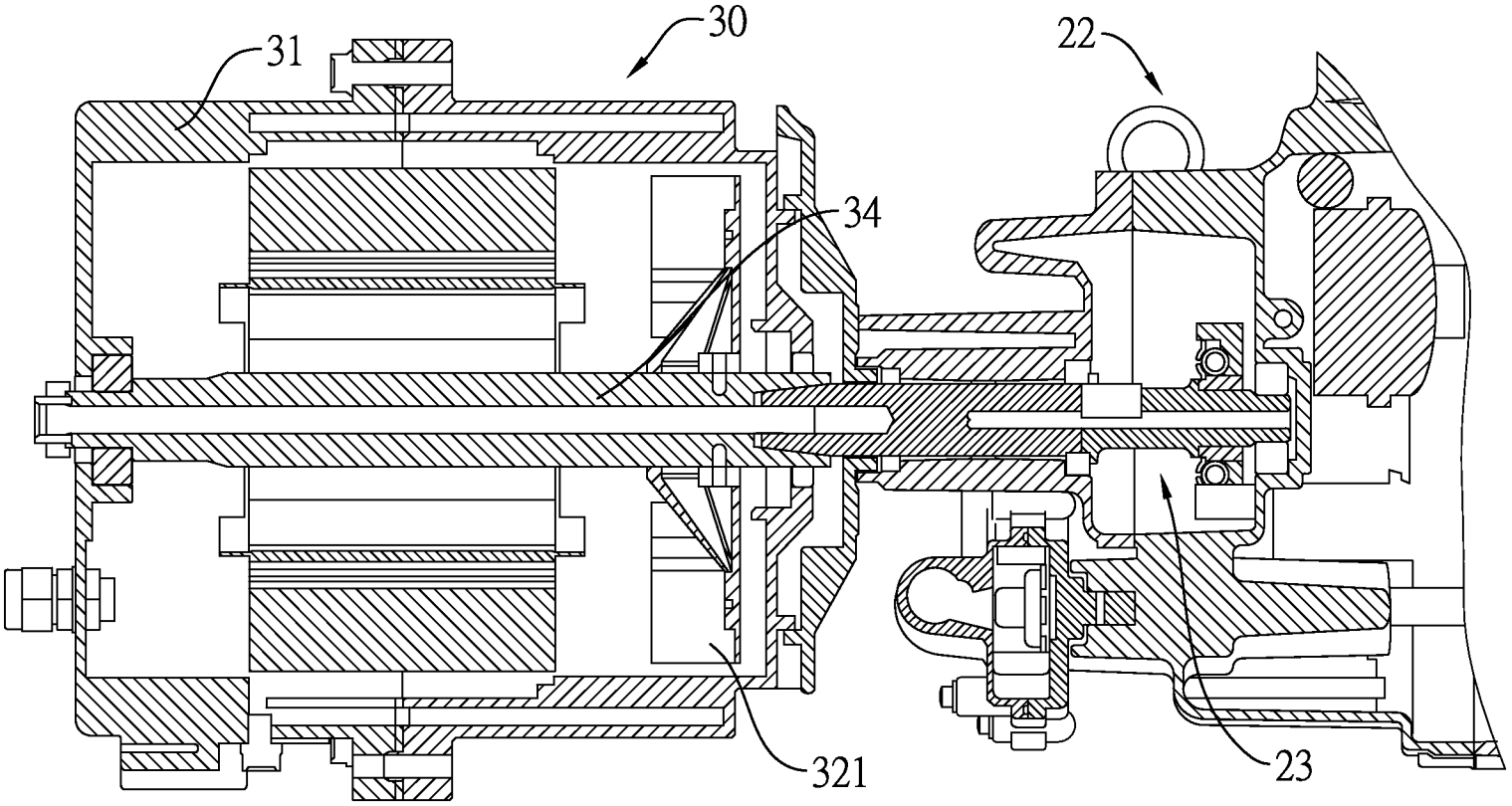
FIG. 5 is a cross-sectional side view of the generator and a transmission box of an engine of the cooling system in FIG. 1.

With further reference to FIG. 5, the engine 20 is conventional and has an exhaust pipe. The transmission box 22 is connected to and driven by the engine 20 and has a conventional continuous variable transmission mechanism 23.

Figure 4:
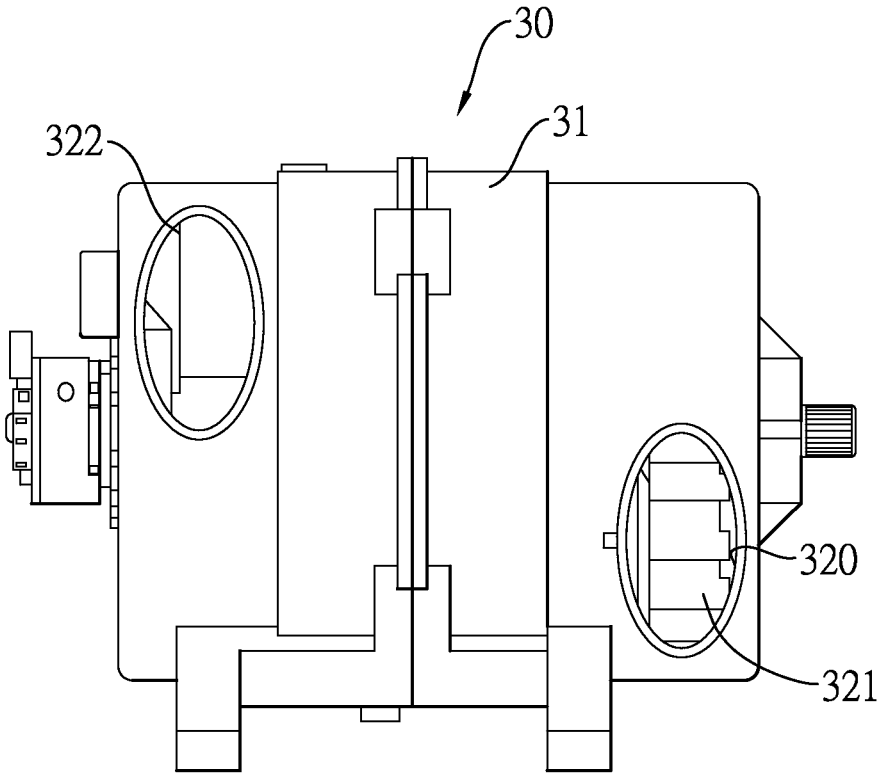
FIG. 4 is a side view of a generator of the cooling system in FIG. 1.

With further reference to FIG. 4, the generator 30 is disposed beside the engine 20 and has a housing 31, a rotor 34, a fan 321 and an outlet pipe 33. The housing 31 is hollow and has an inlet 320 and an outlet 322. The inlet 320 of the housing 31 is formed through the housing 31. The outlet 322 of the housing 31 is formed through the housing 31 and is disposed opposite to the inlet 320 of the housing 31. The rotor 34 is mounted in the housing 31, is connected to the continuous variable transmission mechanism 23 and is driven by the engine 20 via the continuous variable transmission mechanism 23. The fan 321 is mounted in the housing 31, corresponds to the inlet 320 of the housing 31, is connected to the rotor 34, synchronously rotates with the rotor 34 and has multiple blades. The blades of the fan 321 are radially arranged. Each blade may be flat and inclined, or may be twisted and inclined. When the fan 321 rotates, air around the housing 31 is drawn into the housing 31 via the inlet 320 of the housing 31 and is discharged out of the housing 31 through the outlet 322 of the housing 31. In the preferred embodiment, a diameter of the inlet 320 of the housing 31 is equal to a diameter of the outlet 322 of the housing 31. The outlet pipe 33 has a proximal end and a distal end. The proximal end of the outlet pipe 33 is connected to the housing 31 and corresponds to the outlet 322 of the housing 31. The distal end of the housing 31 corresponds to the exhaust pipe of the engine 20.

The wind collection box 40 is disposed beside the engine 20 and the generator 30, is disposed higher than the generator 30 and has a casing, a first guiding tube 42 and a second guiding tube 43. The casing is hollow and has an inlet 41 formed through the casing. The first guiding tube 42 has two ends. One end of the first guiding tube 42 is connected to the casing and communicates with an interior of the casing. The other end of the first guiding tube 42 is connected to and communicates with the housing 31 of the generator 30 and corresponds to the inlet 320 of the housing 31. Thus, the interior of the casing of the wind collection box 40 communicates with the inlet 320 of the housing 31 of the generator 30 via the first guiding tube 42. In the preferred embodiment, a diameter of the first guiding tube 42 is equal to a diameter of the outlet pipe 33. The second guiding tube 43 has two ends. One end of the second guiding tube 43 is connected to the casing of the wind collection box 40 and communicates with the interior of the casing of the wind collection box 40. The other end of the second guide tube 43 is connected to the transmission box 22 and communicates with an interior of the transmission box 22 to guide air into the transmission box 22.

When the vehicle with the cooling system in accordance with the present invention is driving, the engine 20 drives the generator 30 and the fan 321. Since the wind collection box 40 communicates with an exterior of the engine compartment 10, the fan 321 of the engine 20 draws exterior air into the housing 31 of the generator 30 from the inlet 41 of the casing of the wind collection box 40 and the first guiding tube 42. The exterior air flows through the inlet 41 of the casing of the wind collection box 40, the first guiding tube 42 and the inlet 320 of the housing 31 to flow into the housing 31 of the generator 30, and then the exterior air flows into the outlet pipe 33 via the outlet 322 of the housing 31. Thus, heat in the housing 31 of the generator 30 that is mounted in the airtight engine compartment 10 is dissipated.

Since the fan 321 synchronously rotates with the rotor 34, as the rotor 34 rotates at high speed under heavy load, a rotating speed of the fan 321 increases accordingly and the exterior air that is guided into the generator 30 via the wind collection box 40 also increases accordingly. Thus, heat of the generator 30 operating under heavy is efficiently dissipated.

Moreover, the transmission box 22 communicates with the wind collection box 40 via the second guiding tube 43. Therefore, heat of the transmission box 22 is dissipated together with the heat of the generator 30. No additional wind collection box, which might increase cost of the vehicle, is needed, and the compartment is compact.

Since the wind collection box 40 is disposed beside the engine 20, distance between the wind collection box 40 and the engine 20 is short such that the exterior air is drawn into the engine 20 efficiently. Furthermore, since the wind collection box 40 is disposed higher than the generator 30, sands do not enter the wind collection box 40 when the vehicle is driving.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cooling system for a generator of a vehicle, comprising
an engine;
a transmission box connected to and driven by the engine;
a generator disposed beside the engine and having
a hollow housing;
a rotor mounted in the housing and being driven by the engine; and
a fan mounted in the housing, connected to the rotor and synchronously rotating with the rotor; and
a wind collection box, having
a hollow casing having an inlet formed through the casing; and
a first guiding tube having two ends, one end of the first guiding tube being connected to the casing and communicating with an interior of the casing, and the other end of the first guiding tube being connected to and communicating with the housing of the generator; and
a second guiding tube having two ends, one end of the second guiding tube being connected to and communicating with the wind collection box, and the other end of the second guiding tube being connected to the transmission box and communicating with an interior of the transmission box.

2. The cooling system as claimed in claim 1, wherein the second guiding tube is connected to the casing of the wind collection box and communicates with the interior of the casing of the wind collection box.

3. The cooling system as claimed in claim 2, wherein the wind collection box is disposed beside the engine and the generator and is disposed higher than the generator.

4. The cooling system as claimed in claim 1, wherein
the housing of the generator has
an inlet formed through the housing; and
an outlet formed through the housing;
the end of the first guiding tube of the wind collection box that is connected to the housing of the generator corresponds to the inlet of the housing;
the engine has an exhaust pipe; and
the generator further has an outlet pipe having
a proximal end connected to the housing and corresponding to the outlet of the housing; and
a distal end corresponding to the exhaust pipe of the engine.

5. The cooling system as claimed in claim 2, wherein
the housing of the generator has
an inlet formed through the housing; and
an outlet formed through the housing;
the end of the first guiding tube of the wind collection box that is connected to the housing of the generator corresponds to the inlet of the housing;
the engine has an exhaust pipe; and
the generator further has an outlet pipe having
a proximal end connected to the housing and corresponding to the outlet of the housing; and
a distal end corresponding to the exhaust pipe of the engine.

6. The cooling system as claimed in claim 3, wherein
the housing of the generator has
an inlet formed through the housing; and
an outlet formed through the housing;
the end of the first guiding tube of the wind collection box that is connected to the housing of the generator corresponds to the inlet of the housing;
the engine has an exhaust pipe; and
the generator further has an outlet pipe having
a proximal end connected to the housing and corresponding to the outlet of the housing; and
a distal end corresponding to the exhaust pipe of the engine.

7. The cooling system as claimed in claim 4, wherein a diameter of the inlet of the housing is equal to a diameter of the outlet of the housing.

8. The cooling system as claimed in claim 5, wherein a diameter of the inlet of the housing is equal to a diameter of the outlet of the housing.

9. The cooling system as claimed in claim 6, wherein a diameter of the inlet of the housing is equal to a diameter of the outlet of the housing.

10. The cooling system as claimed in claim 7, wherein a diameter of the first guiding tube is equal to a diameter of the outlet pipe.

11. The cooling system as claimed in claim 8, wherein a diameter of the first guiding tube is equal to a diameter of the outlet pipe.

12. The cooling system as claimed in claim 9, wherein a diameter of the first guiding tube is equal to a diameter of the outlet pipe.

13. The cooling system as claimed in claim 10, wherein the transmission box has a continuous variable transmission mechanism.

14. The cooling system as claimed in claim 11, wherein the transmission box has a continuous variable transmission mechanism.

15. The cooling system as claimed in claim 12, wherein the transmission box has a continuous variable transmission mechanism.

* * * * *